United States Patent [19]

Watson

[11] 3,976,276

[45] Aug. 24, 1976

[54] APPARATUS FOR FORMING A CONCRETE FEED BUNK

[76] Inventor: Billy W. Watson, P.O. Box 1942, Clovis, N. Mex. 88101

[22] Filed: Jan. 6, 1975

[21] Appl. No.: 538,610

[52] U.S. Cl. ..... 249/149; 249/162

[51] Int. Cl.[2] ..... B28B 7/16

[58] Field of Search ..... 249/50, 149, 160–162, 249/172, 22; 425/441

[56] References Cited

UNITED STATES PATENTS

| | | | |
|---|---|---|---|
| 736,586 | 8/1903 | Dougherty | 249/149 |
| 786,367 | 4/1905 | Landis | 249/22 |
| 939,059 | 11/1909 | Morris | 249/149 |
| 1,322,784 | 11/1919 | Greuloch | 249/22 |
| 1,337,074 | 4/1920 | Jester | 249/149 |
| 1,447,283 | 3/1923 | Davis | 249/22 |
| 2,548,343 | 4/1951 | Brown | 249/22 |
| 3,303,545 | 2/1967 | Heitzman | 425/441 |
| 3,595,514 | 7/1971 | Sanders | 249/50 |
| 3,743,232 | 7/1973 | Vaughan | 249/162 |

*Primary Examiner*—Francis S. Husar
*Assistant Examiner*—John McQuade
*Attorney, Agent, or Firm*—Ely Silverman

[57] ABSTRACT

A concrete feed bunk is formed and cured in a series of like dimensionally stable yet expansible multi-surfaced molds. Each mold is separated from a cured concrete portion of the bunk formed by such mold by a first step of automatically splitting the concrete from the mold along vertically extending surfaces of juncture and along horizontally extending surfaces of juncture of mold and cured concrete followed by a second step of raising and concurrently expanding the mold to avoid damage to the cured concrete mass. A novel degree of rigidity of moving mold wall parts provides for the uniformity of the splitting action and surface characteristics of final concrete product and the mold structure provides for automatic and reliable dimensions of the cured concrete mass and rapid operation.

3 Claims, 16 Drawing Figures

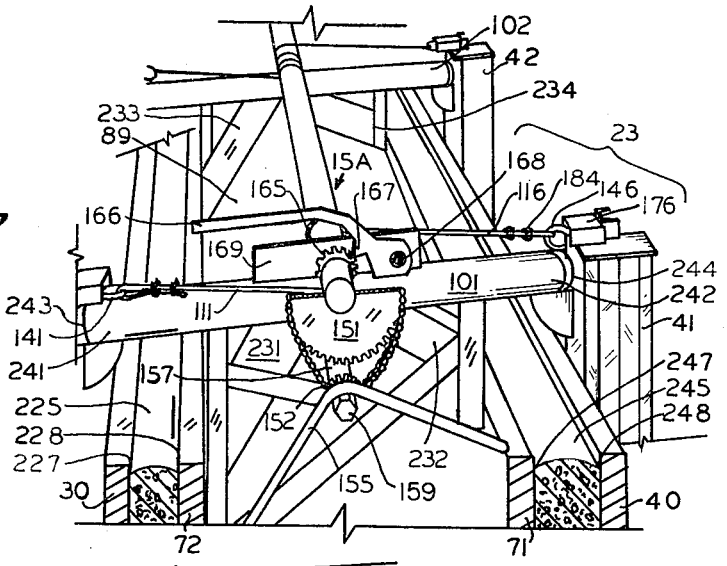
FIG.7
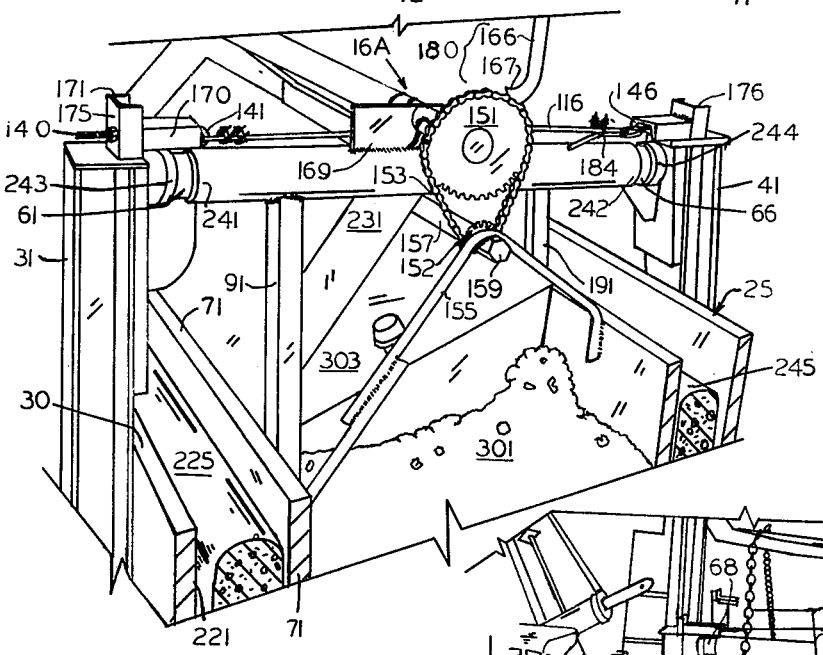
FIG.8
FIG.9
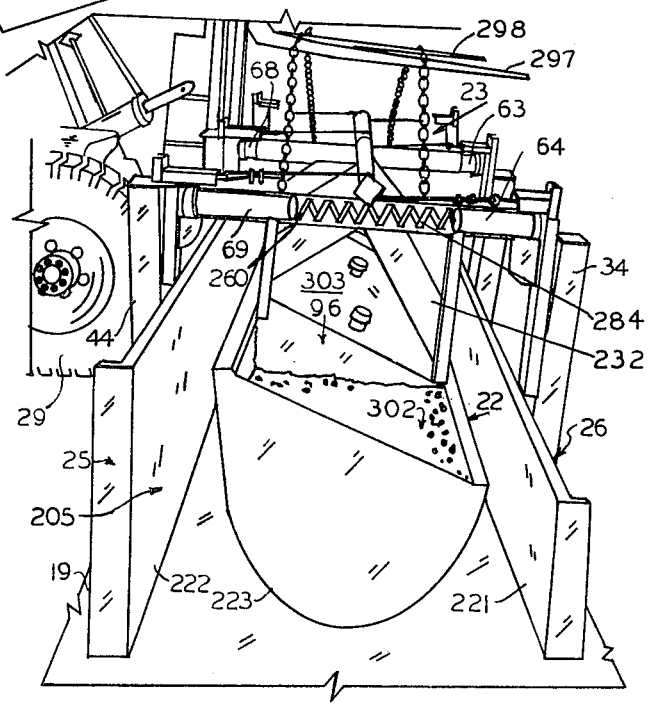
FIG.15
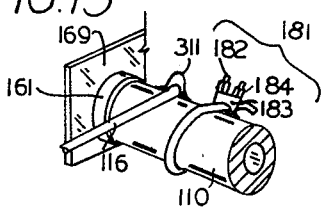
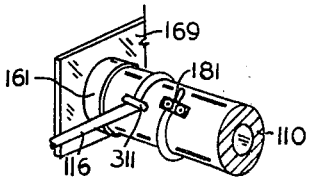
FIG. 16

APPARATUS FOR FORMING A CONCRETE FEED BUNK

BACKGROUND OF THE INVENTION

1. Field of the Invention

This field of the invention is apparatus and mechanism making a concrete mold for feedlot troughs.

2. Description of the Prior Art

The usual prior art method of manufacture of feedlot trough involved the expense of making the feedlot troughs at a central location and suffering the expense of shipping to the place of use, as well as the cost of installation. Where on-site methods were attempted, the reproducibility of the size and shape of each of the units used for a feedlot as well as the orientation of each of the units relative to each other was unsatisfactory as well as expensive and time-consuming because conventional methods of forming concrete bunks resulted in damage such as warping of the form walls following or during removal thereof and resultant undesirable appearance of the finished bunk product.

SUMMARY OF THE INVENTION

A particularly rigid and dimensionally stable trough and frame assembly and controllably movable well assembly attached thereto in combination with a clamp control mechanism providing a limited yet automatically controlled dimensional freedom provide for a dimensionally reliable form; also, in process of separation of the mold from the concrete mass, a first splitting action is automatically produced between horizontally extending mold surfaces and concrete surfaces and vertically extending mold surfaces and concrete product surfaces formed thereby that automatically avoids surface defects and improves surface smoothness of the bunk feeder produced and, after such splitting, there is an automatic spreading of mold parts to avoid damage to cured concrete mass produced within the mold during subsequent handling and transport of that mass because the mold transporting means — a forklift truck — is used to provide the power to trip a spreading mechanism as well as move the mold in a manner that maintains safe orientation of the bunk surfaces relative to the mold surfaces.

BRIEF DESCRIPTION OF THE DRAWINGS

FIG. 4 shows the mold assembly 20 in the position of parts immediately prior to the initiation of steps whereby to separate the mold assembly from the concrete and wherein that assembly is in its contracted position, as shown in FIG. 7, and the volume between the surfaces of the mold has been filled with concrete.

FIG. 5 is a diagrammatic vertical transverse section, exaggerated for purpose of clarity, illustrating the initial movement of parts of the wall assembly 21 of the apparatus 20 and changes in position of parts of mold clamp assembly 23 following initial stage of release of the mold clamp assembly 23 with apparatus 20 resting on ground 19.

FIG. 6 is a transverse vertical section in the position of parts of the apparatus 20 after it has been raised a small distance off the ground by the transport forklift 29.

FIG. 7 is a top oblique view of zone 7A of FIG. 3 along direction of line 7B of FIG. 1 from above left end of assembly 20 and shows the position of parts at a point of operation at which mold clamp assembly 23 is in its contracted position while in position of apparatus 20 as in FIG. 4. The top sprocket wheel 151 is broken away to illustrate the toothed locking sprocket 165.

FIG. 8 is a side oblique view of the zone 7A and along direction 8A of FIG. 3 of apparatus 20 wherein the mold clamp assembly thereof 23 is in its fully expanded position after slight raising of assembly 20 as in FIG. 8. The handle end of arm 166 (shown in FIG. 7) is cut off in this view.

FIG. 9 is an end perspective view of the portion of apparatus unit 20 shown in zone 9A of FIG. 1 and shows the position of such parts of apparatus 20 with the mold clamp assembly 23 in its expanded position, as in FIG. 6, when slightly raised above ground 19 by truck 29. Sleeve 104 is broken away to illustrate the structures therein in this view. Mold chamber 205 is empty in this view.

FIG. 15 is an enlarged perspective diagrammatic view along direction of arrow 15A of FIG. 7 to show attachments of cable 116 to tube 110 in tightened position of crank assembly 150, as in FIGS. 4 and 7.

FIG. 16 is a similar diagrammatic view of the same zone as in FIG. 15 with cable 116 in its extended condition as in FIGS. 6 and 8 as seen in direction of arrow 16A of FIG. 8.

Figure 1:
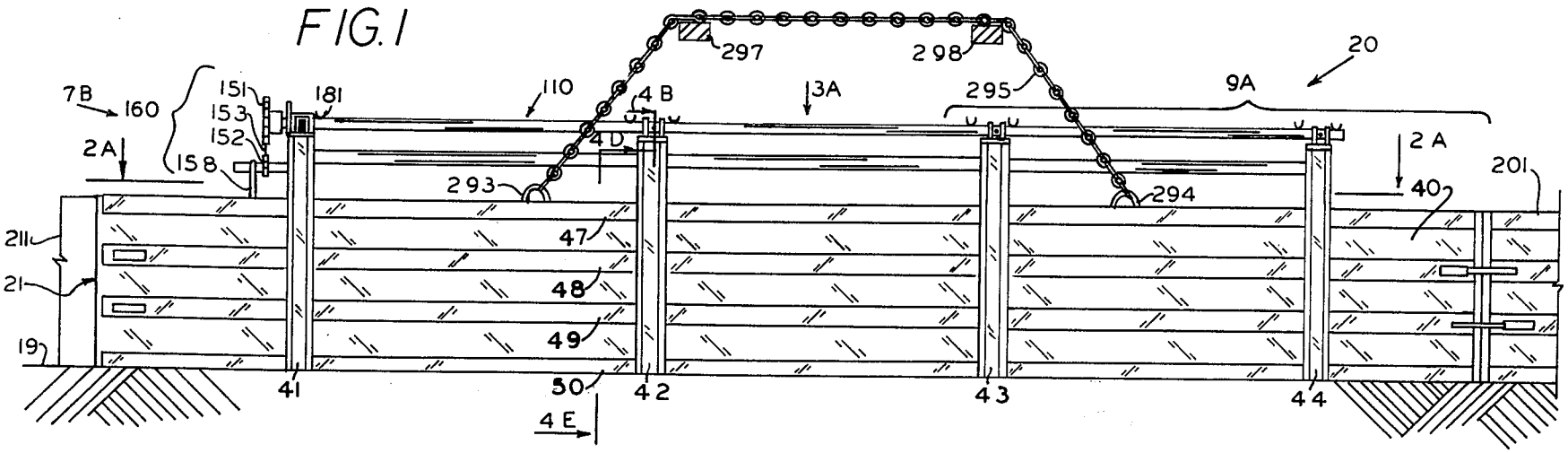
FIG. 1 is a side view of apparatus unit 20 taken along the direction of 1A of FIG. 2, and with chain 153 broken away, in part, to illustrate sprocket wheel 152.

Data on a mold assembly apparatus unit 20 are set out in Table I (Insert A).

In referring to the drawings, "right" and "left" as used herein are right and left, respectively, in the array of apparatus shown in FIGS. 1, 2, 3, and 10. "Front" refers to left in FIGS. 4, 5, 6, 7, 8, 11 and 14 and to right in FIG. 9 and upwards in FIGS. 2, 3 and 10.

DESCRIPTION IF THE PREFERRED EMBODIMENT

Figure 10:
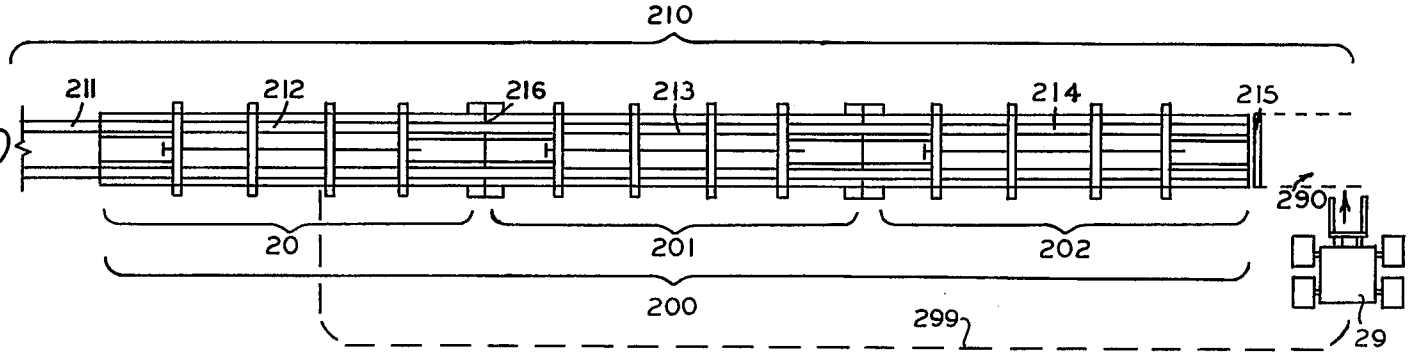
FIG. 10 is a diagrammatic top view of an operatively connected series of like units 20, 201, 202, in an operating system 200.

The overall assembly 200 comprises a plurality of like units as 20, 201 and 202 removably yet operatively connected in series as diagrammatically shown in FIG. 10. The description of the single apparatus unit 20 is applicable to the structure and operation of all other like units of the series assembly 200.

The assembly 200 is operated to produce on ground 19 a long concrete feed bunk 210 of uniform vertical transverse cross section. The finished feed bunk 210 is composed of serially connected like portions as 211, 212, 213, 214 and is usually several hundred feet long when completed. Each of such portions as 212, 213, 214 is formed in one of the like mold units as 20, 201, 202, respectively, and is firmly joined at ist left and right ends to the neighboring units, e.g. righthand end of bunk portion 211 is firmly joined to lefthand end of bunk portion 212 and righthand end of feed bunk portion 212 is firmly joined to left end of feed bunk portion 213. Each mold section as 213 is formed between surfaces of mold unit 201 similar to the like surfaces 221, 222 and 223 of the mold unit 20 and the adjacent formed end as 216 of the adjacent bunk portion as 212 and a mold end plate, as 215, (shown on mold unit 214 in FIG. 10) on that mold unit 201.

The apparatus unit 20 is a transportable and releasable mold assembly and comprises an exterior wall subassembly 21, a trough and frame assembly 22 and a mold clamp assembly 23 in operative combination.

The exterior wall subassembly 21 comprises a rear wall unit 25 and a front wall unit 26. The rear wall unit 25 is composed of a flat vertical panel 40, longitudinal members and vertical members all firmly joined together.

More particularly, rear wall unit 25 is composed of a central vertical flat panel 40 with vertically spaced apart horizontal members 47–50 firmly fixed thereto and, laterally thereof, horizontally spaced apart rigid vertical members 41, 42, 43 and 44 and left and right end connector members 45 and 46. Each of these vertical members are firmly attached to the rigid and parallel horizontally extending upper longitudinal reinforcing member 47, middle longitudinal reinforcing member 48 and bottom longitudinal reinforcing member 49 and base longitudinal reinforcing member 50. The longitudinal members 47, 48, 49 and 50 are each rigid and firmly fixed at their interior side to the exterior surface of the flat imperforate panel 40. The interior surface of panel 40 is smooth and flat. The outer surface of each of the reinforcing members 47, 48, 49 and 50 is firmly attached as by welding to the vertical members 41, 42, 43 and 44 at their points of intersection, as shown in FIGS. 1–6, and this joining is very rigid throughout at such area of juncture, in same manner as for front wall 26.

The front wall 26 comprises a rigid flat front panel 30 and directly joined thereto vertically spaced apart horizontal members 37, 38 and 39 and end connecting members 35 at the left end and 36 on the right and vertical members 31–34. The horizontally extending reinforcement members — 37 is at the top; 38 is at the middle and 39 is at the bottom — are rigid and stiff and provide for maintaining the panel 30 against curving about a vertical axis. The vertical members 31–34 are identical to 41–44 and are rigid and rigidly attached to reinforcement members 37, 38 and 39 and prevent the bending of the panel surface 30 about a horizontal axis parallel to the ground 19 on which the apparatus 20 rests.

A left rear connector plate 45 is firmly connected both to the vertical interior panel 40 of the rear wall assembly 25 and also to the longitudinal reinforcing members as 47, 48, 49 and 50 at the left end of the apparatus unit 20 while a right rear connector plate 46 is firmly connected to the panel 40 at the right end of unit 20 and to longitudinal members 47, 48, 49 and 50.

A left front connector plate 35 is firmly connected both to the vertical interior panel 30 of the front wall assembly 26 and also to the longitudinal reinforcing members 37, 38 and 39 at the left end of the apparatus unit 20 while a right front rear connector plate 36 is firmly connected to the panel 30 and also to the right end of longitudinal members 37, 38 and 39.

Each of the connector plates 45, 46, 35 and 36 is a rigid flange that serves to stiffen and keep straight the longitudinal members (37–39 or 47–50) and plate member (30 or 40) to which it is attached.

Each apparatus unit as 20 is provided with a left front locking and connector unit 51 at the left front end of longitudinal member 38, a right front lock and connector unit 52 at the front of right end of front longitudinal member 38, a left rear lock and connector unit 53 on the rear of left end of rear longitudinal member 49 and a right rear lock and connector plate 54 at the rear right end of rear longitudinal member 49. Adjustable lock arms 55, 56, 57 and 58 of the left front lock and connector unit 51, the right front lock and connector unit 52, the left rear lock and connector unit 53, and the right rear lock and connector unit 54, respectively, releasably yet firmly connect adjacent sections as 20, 201 and 202 of apparatus as 200, as shown for connection of sections 201 and 20 in FIGS. 2 and 3. Generally, as shown in FIG. 10, a series of like modular units such as the apparatus unit 20, one such section being 20, the adjacent unit being 201 and the serially next section as 202, are each identical to each other and are joined by the lock arms as 56–58 of units as 52 and 54 between units 20 and 201 and like connectors connect such section 201 to the succeeding unit 202 in the operative position of parts while the concrete (as 24, in one particular mold section, as 20) is setting in each of such sections.

Each of the front vertical members 31–34 is a rigid I-beam with a rigid solid cylindrical horizontally extending piston 61, 62, 63, 64, respectively, firmly attached thereto and each of the rear vertical members 41, 42, 43, 44 is a rigid I-beam with a rigid solid cylindrical hoeizontally extending piston 66, 67, 68 and 69, respectively. Each of the rear pistons 67, 68, 69 is coaxial with a piston of a front vertical member, as piston 61, 62, 63, 64, respectively. Each of two pistons 61 and 66 are slidably yet firmly held in one transverse sleeve 101 while the pistons 62, 63, 64 are respectively slidably held in the front end of transverse sleeves 102, 103 and 104 while the rear pistons 66, 67, 68, 69 are located at the rear end of the transverse sleeves 101 102, 103, 104, respectively and act in the same manner.

The trough and frame subassembly comprises the trough mold 70, a plurality of transverse partitions 77–80, frame supports 91–94 and 191–194 the transverse sleeves 101–104, in cooperative combination. The trough and frame assembly 22 also provides support for the mold clamp assembly 23 and, further, in cooperation with the frame clamp assembly 23, the trough and frame assembly 22 supports the portions 25 and 26 of the wall assembly 21 and maintains them in alignment, and assembly 23 is very rigid.

Figure 6:
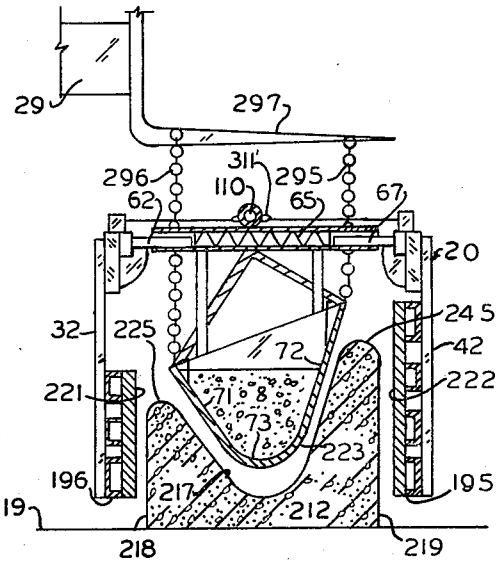
FIGS. 4, 5 and 6 are transverse vertical sectional views taken along broken vertical section 4B–4D of FIG. 1 to diagrammatically illustrate the operation of the apparatus unit 20, and shown to same scale.
Figure 5:
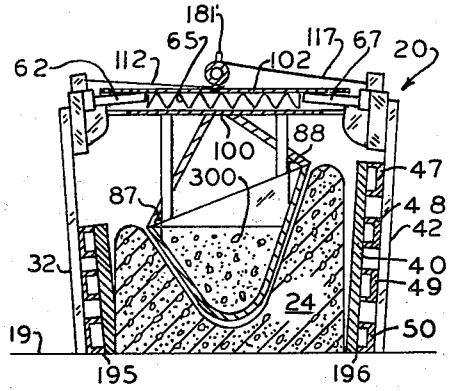
Figure 4:
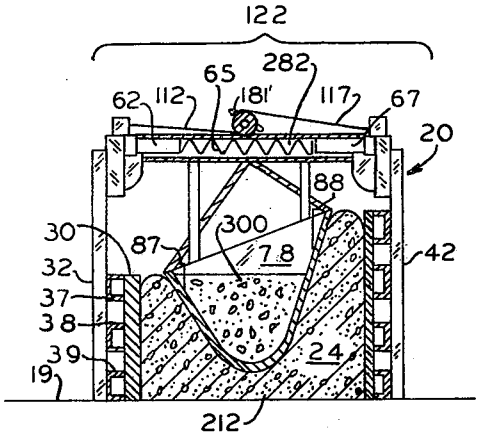

The trough mold 70 is a longitudinally extending rigid horizontal curved steel sheet or plate (¼ inch thick) of longitudinally uniform downwardly convex and upwardly concave transverse outline; as shown in FIGS. 4–6, its outer surface is smooth and forms a smooth surface for the mass of concrete, as 24, formed in each apparatus unit as 20. Trough mold 70 comprises a front, upwardly and forwardly sloped, portion 71, a rear, upwardly and rearwardly sloped, portion 72 and a bottom, curved downwardly convex, portion 73. The portion 73 is a portion of a right cylinder and has a smooth outer surface 223 continuous with the outer surface of the front portion 71 which is flat; the rear portion of the curved portion 73 is tangent to the flat rear lower surface of portion 72. Each of a plurality of end partitions 75 and 76 and transverse partitions 77, 78, 79 and 80 is each formed of an imperforate rigid plate and each is curved at its periphery to match the interior surface of mold trough mold 79, as shown in FIG. 4, and each firmly joined at its edge to the inner surface of the trough mold 70, as shown for partition 78 in FIG. 4, in watertight manner.

Rigid ell shaped longitudinal trough edge reinforcement members 87 and 88 extend along and are attached to the front and rear edges, respectively, of trough mold 70.

Figure 2:
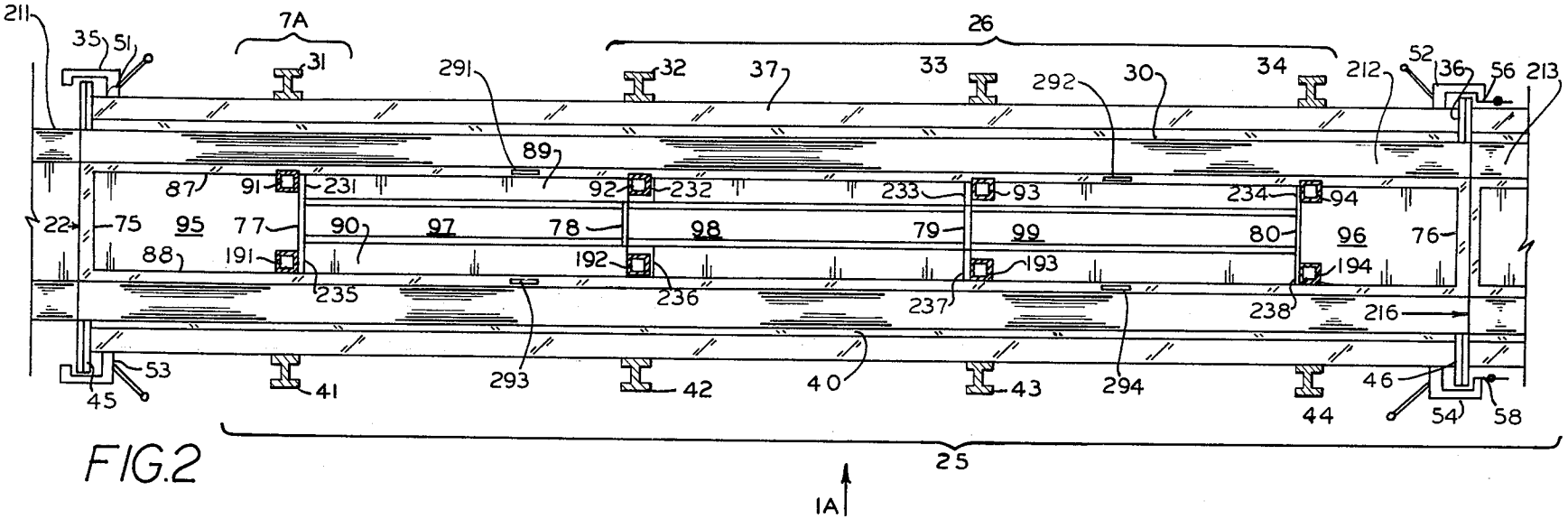
FIG. 2 is a longitudinally extending horizontal sectional view taken along sectional plane 2A—2A of FIG. 1.

Rigid vertically extending front frame clamp cylinder supports 91, 92, 93 and 94 are attached to the top of the front edge of the trough assembly on the interior thereof (as shown in FIGS. 2, 4, 5, 6) firmly attached to the interior surface of the trough edge reinforcement and support member 87, and like rigid vertically extending rear frame clamp cylinder supports 191, 192, 193 and 194 are provided at the top of the trough assembly on the interior thereof (as shown in FIGS. 2 and 4) firmly attached to the interior surface of the rear trough edge reinforcement and support member 88. These frame support members 91–94 and 191–194 are firmly attached at their upper ends to transverse frame cylinder sleeves 101, 102, 103, 104, respectively.

Longitudinally extending sloped front cover plate 89 and area cover plate 90 are flat rigid steel plates of uniform thickness and imperforate and firmly attached to each other at an upper center line of juncture 100 at their top edge while the bottom edge of each plate 89 and 90 is firmly welded to the reinforcing longitudinal support members 87 and 88, respectively, and rigidifies the trough 70.

Chain rings 291, 291, 293 and 294 are fimly attached to left and rigid sides of longitudinal trough reinforcing members 87 and 88 for engagement with lifting chains 295 and 296.

The mold clmap assembly 23 comprises a torque tube 110 and a wall crank assembly 150, cables 111–114 and 116–119 and piston and sleeve assemblies 121–124.

The torque tube 110 is an elongated straight cylindrical sturdy steel tube of uniform transverse cross section and circular outline; it is substantially rigid being made of a low carbon steel but has some resilient flexibility to avoid cracking. The torque tube 110 is rotatably located in each of a series of journals, journal 161 on top of the transverse sleeve 101, journal 162 on top of transverse sleeve 102, journal 163 on top of transverse sleeve 103, journal 164 on top of transverse sleeve 104. Each of journals 161–164 is firmly and fixedly attached to the top of sleeves 101–104, respectively. Journal 161 is in plate 169.

A cable post, as 171, is attached at the top of vertical member, as 31, and like cable posts 172, 173, 174 are similarly firmly attached to each of the vertical posts 42, 43, 44, while similar cable posts 176, 177, 178 and 179 are attached to the rear posts 41–44.

As shown in FIG. 8, each cable post as 171 and 176 comprises a rigid steel rectangular box, closed at its sides and top with a hole in its outer wall for attachment of the shaft of an eyebolt and a central opening for an eyebolt eye and cable. The walls of the box are formed of channels as 170 and 175 firmly joined to each other and to the top of member 31.

A front cable 111 extends from a firm attachment to the torque tube 110 and is firmly attached thereto (as at attachment 181) and extends to an eyebolt 141 that extends through a hole in front wall of the front cable post 171. Eyebolt 141 is provided at its threaded front end with a nut 140 for adjustment of cable 111 tension and length. Similar cables 112, 113 and 114 are similarly attached to the cable posts 172, 173 and 174 on the front vertical members 32, 33 and 34 through eyebolts and nuts 142–144, each like eyebolt and nut 141, while the rear cables 116, 117, 118 and 119 are similarly attached to the torque tube 110 and extend to the rear eyebolt and nuts 146–149, respectively, which are joined similarly to the rear cable posts 176, 177, 178 and 179 on the rear vertical members 41, 42, 43 and 44, respectively.

Figure 11:
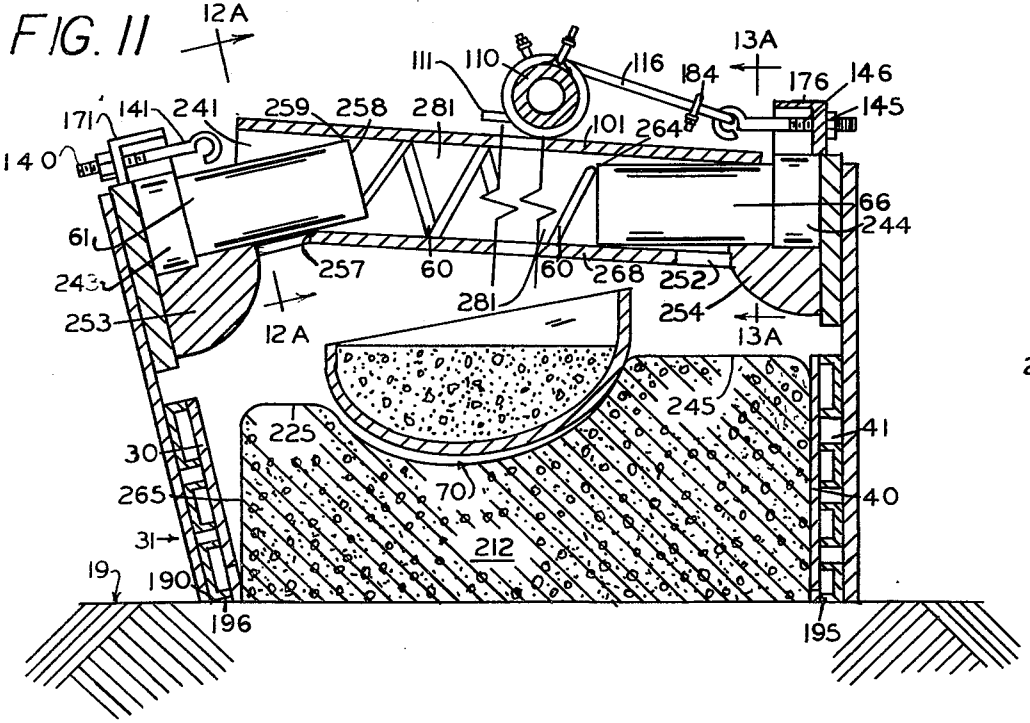
FIG. 11 is a composite diagrammatic vertical transverse view through sleeve 101 to illustrate relations of the pistons as 61 and 66 to the transverse sleeve therefor of piston and sleeve assembly 121 in initial stages of movement of the mold clamp assembly as in FIGS. 4 and 5, and other geometrical relations exaggerated for illustrative purposes.

The attachments for each of the cables 111–114 and 116–119 to the tube 110 is by each cable as 116 wrapping around the tube 110 for at least 360° and then extending to and resting in the arms of a U-bolt as 182 that is welded at its bottom to the tube 110 while a U-bolt clamp as 183 firmly clmaps each cable as 116 to the U-bolt therefor, as 182, as diagrammatically shown in FIG. 11 as attachment 181. Cable clamps as 183 are held firmly by nuts 184 on each such clamp and provide for adjustably yet firmly holding the lateral end of each cable as 116 (in FIG. 11). The nuts as 140 on each threaded eyebolt as 141 (and 142–144) and 146–149) provide for fine adjustment of each cable length from attachment (as 181) of each cable (as 116) to the torque tube 110 for each of cables 111–114) and 116–119.

The wall crank assembly 150 comprises a locking assembly 180 and a sprocket wheel assembly 160: sprocket wheel assembly 160 comprises, in operative combination; a large toothed sprocket wheel 151 fixedly attached to the left end of the rotatable torque tube 110, which torque tube is rotatably attached in the journals therefor 161–164; a small toothed drive sprocket wheel 152 supported on a short stub axle 156, which axle is rotatably supported on journal supports 155 (which are attached to the sides of the trough 70) and sleeve 157 (on the reinforcing plates 231 and 232 of plates 89 and 90) a chain 153, a drive nut 159 and locking sprocket 165. The drive sprocket wheel 152 is rotatably located in a journal 168 therefor and a hexnut 159 is provided at end of shaft 156 for turning the stub shaft 156 and thereby driving the drive sprocket wheel 152; wheel 152 is operatively connected to chain 153 to drive the sprocket wheel 151. Rigid toothed locking sprocket 165 is fixedly attached to the torque tube 110; a rigid lock arm 166 is pivotally mounted on a horizontal shaft of an arm pivot support bolt 168: bolt 168 is firmly mounted in horizontal position on a rigid upright plate 169 that is fixedly attached at its bottom to top of sleeve 101, as shown in FIGS. 7 and 8. A locking tooth 167 on lower edge of arm 166 (shown in FIG. 8) in the lowered position of arm 166, as shown in FIG. 7, engages teeth of sprocket 165 in lowered position and is removed from such engagement in raised position of the arm 166, as shown in FIG. 8. In operation of apparatus 20, a four foot long arm wrench is attached by an operator to the hexnut 159 to turn the drive sprocket 152 and thereby the sprocket wheel 151 and tighten all of the cables as 111–114 and 116–119 which are, in turn, attached to and move the wall units 25 and 26. Tooth 167 on the arm 166 holds the torque tube 110 in position and holds the walls 25 and 26 in clamped position, as shown in FIG. 4, and raising of arm 166 provides for release of sprocket 165 from arm 166; arm 166 is long, as shown in FIG. 7.

Figure 14:
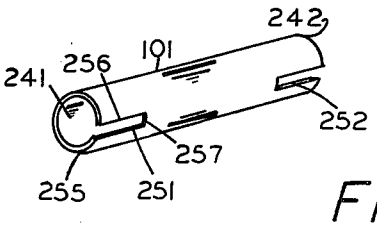
FIG. 14 is a diagrammatic isometric view of bottom of sleeve 101 along direction of arrow 14A of FIG. 13.

Each of the piston and sleeve assemblies 121–124 comprises a sleeve as 101, the pistons therein as 61 and 66 and a spring, as 60, between the pistons. As shown in FIGS. 14 and 11, each sleeve as 101 is a hollow rigid cylinder or sleeve made of steel and has two end slots 251 and 252; slots 251 and 251 each have straight side edges which extend longitudinally parallel to axis of sleeve 101 and with each other; the right edges of slots 251 and 252 lie in the same flat vertical plane and the left edges of slots 251 and 252 are parallel and lie in the same vertical flat plane.

When assemblies 121–124 are compacted, as in FIGS. 4 and 7, each spring as 60, 65 and 260 is under very substantial compression and extends through the sleeve or tube, as 101, 102 and 104 therefor, respectively, from inner edge of one piston as 61 and 64 to the inner edge of the opposing piston as 62 and 69, respectively, in such sleeve, as shown in FIGS. 9 & 10, and moves freely in the chamber 281, 284 of such sleeve.

The outer vertical edge of a rigid fist plate as 253 is firmly attached near to the upper end of arm 31 at the inner side of arm 31 immediately below the attachment of the piston 61 to arm 31 and the upper horizontal edge of the rigid fish plate is attached to the bottom edge of the piston 61 immediately adjacent to the point of attachment of piston 61 to arm 31. Each of the other vertical member arms as 32–34 and 41–44 have fist plates similarly connecting each vertical arms as 31 and 41 with the piston attached thereto, as 61 and 66, respectively, by a fishplate as 253 and 254, respectively.

Vertical support flange trusses, as 231 and 232 and 233–238, are connected to each of plates 89 and 90 adjacent to an joined to each of the upright support posts as 91 and 191, 92, 192, 93, 193, 94 and 194 and extend upward of the plates 89 and 90 and reinforce the plates 89 and 90 and are joined firmly to the transverse piston sleeves 101, 102, 103, 104 to which the upright supports as 191–194 are joined. The sleeves 101–104 are held in fixed orientation as well as position relative to the trough mold 70 by the plates 89 and 90, their flanges 231–238 and vertical post members 91–94 and 191–194.

The base 19 is earth which is very flat and firm; earth for such base to mold units as 20, 201 and 202 is made level for the entire length of the proposed bunk 210, tamped and graded with a grader blade so that over a 20 foot length of a zone as 205 below each unit as 20 there is less than a maximum irregularity of ⅛ inch, and usually less than 1/16 inch.

In the preferred and illustrated mold unit embodiment 20, each front piston, as 61, is horizontal and attached to the front vertical member 31 with a collar 243 (FIG. 8) immediately adjacent and attached to member 31 and the rear piston, as 66, is attached to the rear vertical member 41, with a collar 244 (FIG. 8) immediately adjacent to and attached to member 41. Each collar, as 243 and 244, is a rigid cylindrical pipe portion of the same stock (internal diameter and outside dimeter) as sleeve 101 and is cut at its inner and outer ends perpendicularly to the central longitudinal axis of such collar and of sleeve 101; each sleeve as 101 and each such collar as 243 and 244 on each pair of pistons as 61 and 66, are coaxial in the position of parts thereof shown in FIG. 4. Each end as 241 and 242 of each sleeve as 101 (and the same relations occur in sleeves 102–104) is also cut transversely to the longitudinal axis thereof transversely to the longitudinal axis of the adjacent sleeve.

The crank assembly 150 is tightened as by rotating torque tube 110 counterclockwise by a wrench applied to the hexagonal hexnut 159, which rotates the sprocket wheel 152, and (through chain 153) the sprocket wheel 151, by which rotation of tube 110 the ends of cables 111–114 and 116–119 are drawn around tube 110 and, in view of compression of springs in sleeves 101–104 forcefully urging the pistons as 61–66 outwards of the sleeves, tightens the cables 111–114 and 116–119 and produces the contracted condition of all of the assemblies 121–124, at the same rate and time and thereby brings the walls 25 and 26 to their contracted positions shown in FIGS. 4 and 7. Tightening of cables 111 and 116 draws the left end of collar 244 and the right end of sleeve 101 together and also draws the left end 241 of sleeve 101 and the right end of collar 243 together firmly and evenly.

In the contracted position of the clamp assembly 23, the left end of each sleeve 241, as shown in FIGS. 7 and 14, is directly adjacent to and flush with the right end of collar 243 and the right end of each sleeve as 242, as shown in FIGS. 7 and 14, is directly adjacent to and flush with the left end of the collar as 242 on the opposing piston as 66 (as shown in FIG. 7). This creates a firm dimensionally stable relation between the sleeve 101 and the vertical wall members 31 and 41 at each full tightening of crank assembly. Like precise dimensional relations and distances and angles are created between the members 32, 33 and 34 and sleeves 102, 103 and 104 and the vertical members 42, 43 and 44, respectively, when the crank assembly is tightned fully.

Thus, counterclockwise rotation (as seen in direction of arrow 7B, or as seen viewing apparatus 20 as shown in FIG. 7) of the tube 110 by wheel 151 draws the members 31–34 and 41–44 and the wall panels 30 and 40 towards each other to the contracted position thereof shown in FIGS. 4 and 7 whereat there is a fixed distance therebetween for the formation of a mold volume as 205 within which the bunk portion as 212 is formed from a mass of cement as 24 added thereto.

When crank assembly 150 is tightened fully, dimensions between walls 25 and 26 and the trough 70 are also predetermined and fixed for each of dimentsions of the apparatus 20, as the rigid connections of the trough 70 through the vertical members as 91–94, 191–194, 89, 90 and those flanges 231–234 and 236–239 and the connections of the flanges to the vertiical members and to the sleeves 101–104 provide a very rigid connection that rigidifies and makes stable the spatial and dimensional relations between the wall panels 30 and 40 and the exterior surface 223 of the trough 70. Thereby, the dimensions of mass of cement, as 24, formed in each mold assembly as 20 and 201 and 202 are reliably and precisely and reproducably dimensionally stable at fixed values whenever the crank assembly 150 is tightened. Accordingly, each of the units of bunk portions 211, 212, 213 and 214 formed by the series of mold assemblies as 20, 201 and 202, are identical in size and shape and are, by the connections between such mold assemblies, arranged in recti-linear alignment with each other, as shown in FIG. 10.

The locking assembly 180 consists of the rigid long locking arm 166 and the locking sprocket 165. The arm 166 is pivotally attached to plate 169 by shaft of bolt 168. When the arm 166 in its lowered position, as shown in FIG. 7, the tooth 167 thereof engages with teeth of the sprocket 167 and holds the torque tube 110 and the cables 111–114 and 16–119 in contracted position against the springs as 60, 65 and 260 in sleeves 101, 102 and 104, respectively, and a like spring (not shown) in sleeve 103. The weight of the free end of the arm 166 on the tooth 167 in lowered position of arm 166 is sufficient to keep the tooth 167 in operative engagement with the teeth of the sprocket wheel 165 and hold the torque tube 110 and cables 111–114 and 116–119 in their contracted position. Raising of the arm 166 serves to disengage the tooth 167 from its engagement with sprocket wheel 165 and allows the springs (as 65, 60 and 260) in each of the sleeves as 101–104 to expand and initiates the first step of splitting the mold 20 from the molded concrete while the mold as 20 rests on the ground, and, when the mold as 20 is later raised from the ground by the fork lift truck 29, automatically provides the second step of a further expansion of the springs in the sleeves 101–104 and further separation of the walls as 25 and 26 of each of the molds as 20 from the walls of the molded bunk section as 212. The cables 111–114 are each provided with attachments as 311 to the tube 110 that prevent unlimited expansion of the springs as 60, i.e. permit only limited yet adequate expansion of the pistons as 61 and 66 in each sleeve as 101–104 on such second step because the length of each of pistons as 61 in each sleeve as 110 is greater than the extension of each of cables therefor, as 111.

Each apparatus unit as 20 thus provides a form frame of substantial weight-carrying capacity and weight and rigidity with controlled slidable connections between movable wall units 25 and 26. The weight of apparatus 20 (empty about 3300 pounds) with the additional weight of material added 300, 301, 302 to chambers 95, 96, 97, 98 and 99, holds the unit 20 down against floating action (by concrete added thereto) and serves to position the side walls in place precisely and repetitively against the carefully prepared flat base 19.

In use and operation of the apparatus 20, the walls 221, 222 and 223 are sprayed with oil as coating and concrete is then poured into the chamber 205 located between panels 30 and 40 and bottom of trough 70. The concrete mass is agitated to remove air and to establish a uniform density of concrete and then the concrete mass allowed to stand to cure. The weight of the trough and frame assembly 22 and the contained weight of about 1500 pounds in chambers 91–95 are supported on contracted walls 25 and 26 through engagement of sleeves 101–104 with pistons 61–64 and 66–69. as illustrated in FIG. 4.

The agitation applied to the concrete slurry to provide an even density thereto and chemical action of the concrete slurry remove at least parts of the oily coating on the steel walls; the resulting exposure of metal surface of the mold walls result in some adherence of the concrete mass to the metal surface walls of the mold, 211, 222 and 223 (see FIG. 6), somewhat as the adherence of concrete to steel reinforcing bars, especially when oiling is incomplete or omitted.

The flotation or buoyant effect of the mass of concrete held between interior surfaces of walls 40 and 30 and exterior or downwardly facing surface of trough 70 result in development of pressure in the concrete mass therebetween.

A smooth surface of bunk 24 is desirable for its use as cattle feed trough to avoid damage to animals feeding therefrom from the top curved bunk trough surface 217 and to animals at front surface 219 of the bunk portion 212 and personnel on rear surface 218. By this process and apparatus, the concrete surfaces 217, 218, 219 are separated from the form walls 30 and 40 in a manner that avoids tearing and roughening of the trough wall surface.

The formwork provided by each apparatus unit as 20 is heavy and hard; impact thereof with the green concrete formed therein that is hardened only sufficient to bear its own weight could cause damage to the newly molded and hardened concrete is also avoided by such limited initial separation step.

By the structure of apparatus units as 20, removal of the exterior walls as 25 and 26 of the forms is not necessary because they are positiviely and rapidly and sufficiently spaced away (by apparatus 30) adequately from position at which they might do harm to the hardened concrete on raising of such forms as apparatus unit 20. Such movement of walls 25 and 26 from exterior surface of the formed concrete, as 212, is automatic after the formwork is separated from the hardened concrete, because such second movement is made immediately after the bottom edges of walls 25 and 26 leave contact with the ground 19.

During placement of the mold unit 20, the walls 25 and 26 are held in contracted condition by the mold clamp assembly 23 (all cables 111–114 and 116–119 tightened) and with each of assemblies 121–124 in position shown in FIG. 4 with the top of the pistions (as 62 and 67) held by and supported on vertical members as 32 and 42, respectively, and supporting the corresponding sleeve 102 and the sleeves 101, 103 and 104 supporting the remainder of the trough and frame assembly 22.

After the concrete is placed in the space 205 between mold surfaces 221, 222 and 223 of a mold assembly as 20 and the ground 19 and that space is well filled up to the level of the future top of the bunk feeder, the surface at the future top of the bunk edge, i.e. the zone between the front edge of the upwardly concave surface 217, at the front edge of the mold surface 223 (see FIG. 6) and the vertical surface of the mold 221 is rounded and formed to an upwardly convex surface 225, as shown in FIG. 7. This surface 225 has a uniform transverse cross section shape with an acute solid angle at the straight line of juncture 227 of the front edge of the curved surface 225 and the flat inner surface 221 of the wall 26; this curved surface 225 also forms a forwardly open solid acute angle at the straight line of juncture 228 of the rear edge of surface 225 and the outer surface 223 of the portion 71 of the trough 70.

Additionally, the surface at the future top and rear bunk edge, i.e. the zone between the rear edge of the upwardly concave surface 217 at the rear of mold surface 223 and the rear mold surface 222 is rounded and formed to an upwardly convex surface 245, as shown in FIG. 7. This surface 245 has a uniform transverse cross section shape with an acute solid angle at the straight line of juncture 248 of the rear edge of the curved surface 245 and the flat inner surface 222 of the rear wall 25; this curved surface 245 also has a forwardly directed rearwardly open acute angle at the straight line of juncture 247 of the front edge of surface 245 and the outer surface 223 of the portion 71 of the trough 70.

The front of upwardly convex surfaces 225 is thereby made tangent to the future exterior front surface 218 of the concrete bunk feeder and rear of upwardly convex surface 225 thereby made tangent to the future exterior upwardly concave surface 217 of the bunk feeder as well as providing one line of split between the front surface of the concrete bunk 218 and the rear surface 221 of the front mold wall and another line of split between the downwardly convex mold surface 223 and the upwardly concave concrete surface 217 at the front edge of surface 217. Also, the rear of upwardly convex surface 245 is thereby made tangent to the future exterior rear surface 219 of the concrete bunk feeder, and the front of upwardly convex surface 225 thereby made tangent to the future exterior upwardly concave surface 217 of the bunk feeder as well as providing one line of split between the rear surface of the concrete bunk 219 and the front surface 222 of the rear mold wall 25 and another line of split between the downwardly convex mold surface 223 and the upwardly concave concrete surface 217 at the rear edge of surface 217.

While each of the transverse sleeves as 101–104 rest on and are supported by the pistons therein, as pistons 61 and 66 in sleeve 101, with the top of each piston in contact with the top edge of the inner surface of each such sleeve in the position of parts of assembly 20 during initial location of assembly 20 on the ground and during adding and curing of concrete, as shown in FIG. 4, there is then some slight but definite vertical movement available between each of the pistons as 61 and 66 and the interior of each of the sleeves as 101 in which such pistons are held so as to prevent movement parallel to the central longitudinal axis of the sleeve as 101 by cables as 111 and 116 (attached to the upper end of the arms as 31 and 41 at posts as 171 and 176).

This slight vertical movement permitted between each of the sleeves and the pistons (as 61 and 66) therein, on release of crank assembly 150 and expansion of springs as 60 against pistons as 61 and 66, provides for a peeling or wedging action that smoothly separates the upwardly concave concrete trough surface 217 from the downwardly convex metal mold surface 223 as well as smoothly splitting apart the vertical front and rear metal mold surfaces 221 and 222 from the front and rear vertical concrete bunk surfaces 218 and 219, respectively.

In the operation of release of the apparatus 20 from the molded and curved concrete mass 24 on the release of the tooth 167 of locking arm 166 from sprocket 165 the springs as 60 and 260 in each of sleeves 101–104 push against the pistons as 61 and 66 in sleeve 101 (pistons 62–64 and 67–69 in sleeves 102–104, respectively). The pistons as 62 and 67 on each side of a sleeve as 102 push against each other to expand (through the spring). They do not push against the concrete bunk. Wall units 25 and 26 have substantial and sufficient rigidity against bending about a vertical axis so that all portions of one wall unit are acted upon substantially simultaneously by the expansion of the springs in sleeves 101–104 although wall unit 25 and 26 may start moving at very slighly different, yet different, times; i.e., one wall unit, as 26, (as below described in relation to splitting of mold surface 223 from bunk surface 217) moving while the other 25 is still stationary; as front wall unit 26 is lighter, it usually moves first.

The movement of arm 31 from the vertical position as shown in FIG. 4 (and shown for element 31 in FIG. 11) initially overcomes the resilience of the portions as 255 and 256 of each sleeve as 101 as well as the inertia of the masses of walls 25 and 26 and the friction between the pistons 61–64 and 66–69 and the sleeves 101–104. As below described, such force only moves the walls 25 and 26 for a maximum initial travel of 0.3 inch each before the 7½ inch length of 3.00 inch o.d. pipes as 61–64 and 66–69 jam in the 3.068 inch i.e. sleeves 101–104 and develops a splitting action between mold and concrete surface by developing a wedge angle of about only ½° (0.5°).

Figure 12:
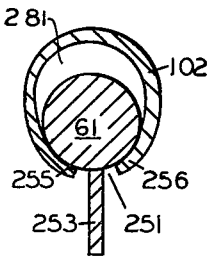
FIG. 12 is a vertical sectional view along section 12A–12A of FIG. 11 to show relations of the piston 61 to the interior of sleeve 101 after the first stage of expansino of the mold clamp assembly 23.

Such limited length of motion (¼ to ½ inch) is also accomplished at a relatively slow speed because of inertia and spring action and mechanical actions provided by the structure of each apparatus unit 20, as below described. FIG. 11 shows in exaggerated diagrammatic manner for purpose of illustrating same, very small physical changes effected over the full height and width of apparatus unit 20. As there shown, spring 60 urges piston 61 laterally and rotates member 31 about its contact 190 with ground 19 because of yielding action of walls adjacent the slot 251 which releases wall portions 255 and 256 adjacent to the slot 251 and allows the 3.00 outside diameter piston 61 to reach a canted position in the 3.068 inch internal diameter sleeve, as shown at left side of FIG. 11. Similar motion occurs (later) on right side of sleeve 101. With a 0.068 inch difference in diameter at 7½ inches of length from central end 257 of slot 251 to interior end 258 of piston 61 an angle (0.5°) that provides a sine of 0.068/17.5 is developed at point 259 as this is as far as piston 61 can travel when the lower end of element 31 is fixed at 190, as it is due to support of the assembly 20 on the lower surface 195 and 196 of wall members 25 and 26, respecctively. With such travel, the movement of 41 inch long element 31 at level of the center of piston 61 is 41 inches × 0.068/7½ inches = 0.37 inches and its movement at level of top of front end of trough portion 225 (which is 19 inches high) is 0.17 inch. Deformation of sleeve 101 is shown in FIG. 12.

The angle at point 265 (the angle between the plane of mold surface 221 and bunk surface 218) is the same as at 259, namely about 0.5° (± 0.05°).

Figure 3:
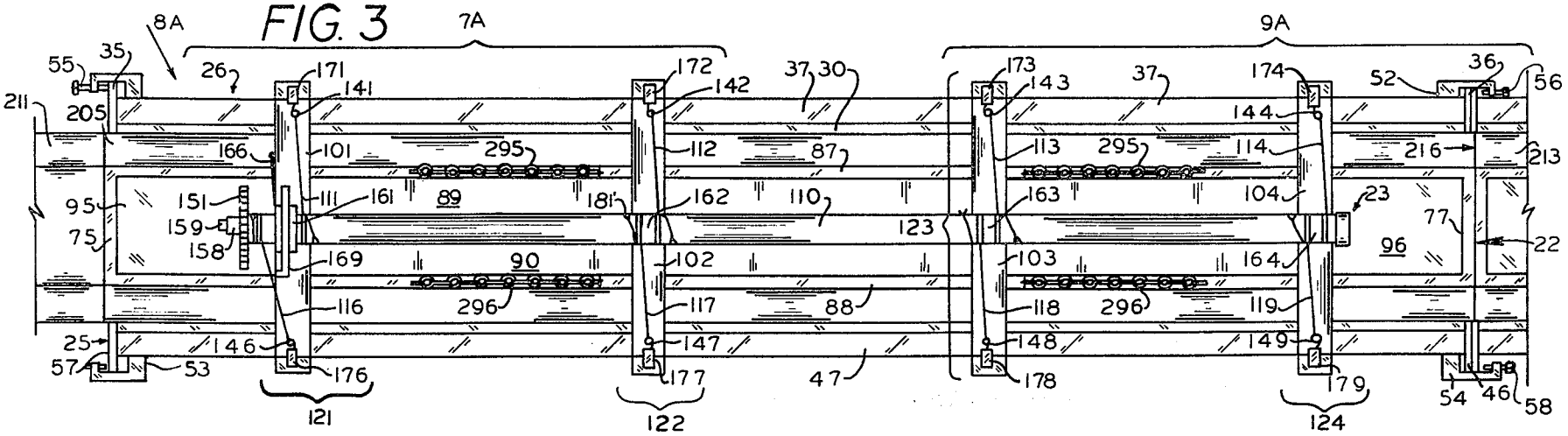
FIG. 3 is a top view of the apparatus 20 taken along the direction of arrow 3A of FIG. 1, at same scale as FIGS. 1 & 2.

In the particular embodiment shown as 20, the above described initial lateral motion (lateral as shown in FIGS. 4, 5, 6, 7, 8 and 11; forward as shown in FIGS. 1, 2, and 3) of piston 61 and arm 31 on release of (by raising arm 166) the earlier wound up (against action of springs in sleeves 101–104) torque tube 110 from the position shown in FIG. 4 to that position shown in FIGS. 5 and 11, raises the inner edge 259 of piston 61 by a maximum of 0.068 inch 9½ inches from left end of sleeve 101, as diagrammatically shown in FIG. 11 (9½ inches from front edge of sleeve 101 as shown in FIGS. 1–6).

Figure 13:
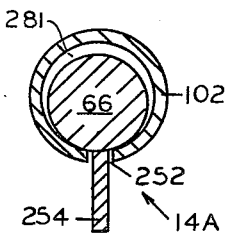
FIG. 13 is a vertical sectional view along section 13A–13A of FIG. 11 to show relations of a piston 66 to the interior of its sleeve prior to expansion thereof.

In the particular embodiment illustrated, the right side of sleeve 101 (shown in FIG. 13) can tilt 0.068 inch in 10 inches initially, as shown in FIG. 11, to accommodate some of the tilt in sleeve 101 produed by the lateral motion of piston 61 (leftward in FIGS. 4, 5 and 11) while apparatus 20 is supported on ground 19 by walls 25 and 26. By virtue of this upward motion of piston 61 and tilting or canting of piston 66 relative to sleeve 101, the front edge 241 (the left edge in FIGS. 4, 5 and 10) of sleeve 101 is raised about 0.03 inch prior to any movement of arm 41 laterally (when arm 31 moves first and arm 41 pivots thereafter). On such raising of one (left in FIG. 11) end of sleeve 101, the bottom surface 223 of the trough 70 is raised at its left (as shown in FIG. 11) edge about 0.03 inch and split or peeled from concrete surface 217 as fast as each of the pistons 61 and 66 displace heavey grease theretofore located above and below it to reach their above described canted or tilted positions relative to the sleeve 101.

The splitting action above described between concrete bunk front surface 218 and front mold surface 221 on limited (¼ to ½ inch) expansion of front piston 61, while front wall 26 rests on the ground, occurs also between concrete bunk rear surface 219 and rear mold surface by limited expansion (of ¼ to ½ inch) of rear piston 66, as shown in FIG. 5, while the bottom of rear wall 25 rests on the ground after release of spring 60 due to jamming of piston 66 in tilted or canted position (as shown in FIG. 5) in rear end of sleeve 101 at the same angular relation of piston 66 to sleeve 101 and at the same angular relation of rear mold wall surface 222 to rear bunk wall surface 219 as above discussed, respectively, for piston 61 to front of sleeve 101 and at the same angular relation of front mold wall surfaces 221 to front bunk wall surface 218.

Adjustment of nuts, as 140 & 145, provide fine adjustment for precise positioning of each vertical member as 31–34 and 41–44 relative to 70 for precise dimensioning of the position of surfaces 218 and 219 relative to the trough surface 217 in view of production variations in position of fastening of the cables 111–114 and 116–119 to the tube 110, and elasticity of steel used for tube 110, so that the collars 243 and 244 and sleeves as 110 may match precisely on tightening of the crank assembly 150.

After mold 24 is formed and cured, each mold apparatus unit as 20 is disconnected as at connecting assemblies as 52 and 53 from adjacent like mold units, as 201. Then, and before (preferably, or after) initial release of arm 166 provides for splitting of the concrete surfaces of the bunk from the metal surfaces from the mold apparatus unit 20, one chain 296 is connected to chain hooks 291 and 292 on the front side of the mold unit 20 and chain 295 is connected to the chain hooks 293 and 294 on rear side of the mold unit 20. The chains 295 and 296 are of the same length and strength and elasticity. After such connection to hooks 291–294, the chains 295 and 296 are placed over the forks 297 and 298 of the fork lift truck 29.

The tines 297 and 298 of the fork of the truck 29 are rigid and, as shown in FIGS. 6 and 9, the top of each fork tine 297 and 298 is substantially parallel to ground 19; the forks are located, as shown in FIG. 1, at substantially equal distances from the center of gravity of the mold unit 20 with such load of added material as it carries in compartments 91–95. The load is gravel or concrete as at 301 and 302 in some compartments as at 301 and 302 in FIGS. 8 and 9 and not shiftable and filled with concrete with the compartment top closed by a cover, as 303 (FIGS. 8 and 9) and 304 for compartments 97, 98, and 99.

The lift truck raises its tines 297 and 298 and the mold apparatus 20 after the initial splitting separation of the surfaces 221, 222 and 223 mold 20 and the surfaces 218, 219, 217 of the bunk (such initial separation occurs while the mold unit 20 is still supported on and held to the ground by walls 25 and 26, as shown in FIGS. 5). The rigid trough and frame assembly 22 is raised by the chains 295 and 296 without any appreciable distortion of the very rigid trough and frame assembly 22 and the wall unit 25 and 26 are raised by their connection to and support by the pistons 61–64 and 66–69 in the sleeves 101–104 of the frame assembly 22. As the walls 25 and 26 are lifted at usual rate of 3 feet in 5 seconds, all portions of the bottom edge of the bottom member (as 39 and 50) of each wall unit (26 and 25, respectively) rise vertically at substantially the same rate and at the same time; on the initial loss of contact of the bottom edge of the wall units and the ground, the springs in each sleeve as 101–104 (as 60 and 260 in 101 and 104) expand a total of 4¼ inches and move the walls 25 and 26 away from each other, as shown in FIG. 6 and 8 (2⅛ inches on left side of each sleeve as 101 and same distance on right side as shown in FIGS. 6 and 9); such movement is adequate to avoid any impact of the mold unit 20 supported on the chains and fork lift truck 29 from impact with the earlier formed concrete bunk section formed by that mold unit (20), when the mold is lifed above the top of the bunk (i.e., surface 245).

The fork lift 29 then transports the lifted apparatus 20 (as by path 299 shown in FIG. 10) to another bunk section forming site 290 whereat the mold apparatus unit 20 is placed parallel to and adjacent to and in line with another like unit, as 202, in which concrete added to the zone as 205 between mold surfaces thereof had been cured (to form bunk section 214). The end plate 215 is removed from mold apparatus unit 202 and the end members as 35 and 45; connector members as 51 and 52 of unit 20 are connected to end member and connector members on unit 202 like members 36 and 46 and 52 and 54 of unit 20.

In view of the possibility of subsequently developed impact between unit 20 and molded concrete masses 24 when the entire unit 20 is lifted, as shown in FIG. 6, a greater degree of movement of the vertical arms and heavy walls is provided to avoid accidental striking of the finished mold by the unit 20 (made more weighty for purposes of avoid floating). Such second spreading action is automatically effected as soon as it is needed, namely when the apparatus 20 begins to be raised off the ground, as shown in FIG. 6. This two-step operation, accordingly, provides for an initial extremely efficient splitting action by a minimum amount of displacement of the walls 25 and 26 at the time of initial spreading, as shown in FIGS. 5 and 11, so that a very small wedge or splitting angle is created between the walls 25 and 26 on initial movement from surfaces 221 and 222 so that the full stiffness and resilience of the side walls may be utilized to avoid any cracking as might result from a greater initial displacement and oscillation of the walls and striking of the mold thereby. However, to avoid damage to the walls, on later moving the unit 20 upward, a second expansion is provided to avoid any damaging action which might otherwise occur were the walls 25 and 26 not sufficiently spaced from each other to avoid any accidental damage to the mold surfaces as 218 and 219 during raising and removal of the entire assembly 20 from the molded and curved concrete mass 24.

Each of pistons as 61 and 66 is provided with a heavy surface coating of heavy long lasting grease, such as axle grease, to facilitate movement of such pistons in the sleeve therefor, as 101. Such heavy grease also slows down movement of such pistons transverse to the central longitudinal axis of such cylindrical sleeves in the same manner as in a hydraulic shock absorber.

As the weight of the assembly 20 is substantial (see Table I), there is a sufficiently great pressure placed on the surface below the walls 25 and 26 and a sufficient volume of earth accumulated immediately centrally of surfaces 221 and 222 and adjancent to earth surface 19 when the assemblies 121–124 are contracted from expanded condition (usually about 2 inches) after the mold 20 is located at a site as 290 in its expanded condition, that no leakage of cement occurs from below the bottom edge of each wall as 25 and 26 and the earth surface 19 when such cement is added to the zone as 205 and during the curing of such cement.

The length and diameter of the pistons as 61 and 66 and the sleeves therefor and the length of arms as 31 and 41, may vary to provide that angle 265 be in the range of from ¼° to 1.0°. The initial — as in FIG. 5 — total lateral displacement of walls 30 and 40 at one unit, such as 122, of 0.5 to 1.0 inch from the contracted position of FIG. 4 creates a splitting and wedging action along the faces as 218 and 219 of the concrete mass 24, with narrower portion toward the portions of the walls 221 and 222 adjacent units 121 and 123. This wedging or splitting action is due to the dimensionally very small but still significant flexibility of the very rigid walls 25 and 26 due to presence of sturdy longitudinal reinforcing members as 37, 38, 39 and 47, 48, 49.

I claim:

1. A concrete mold assembly comprising, in operative combination, an exterior wall assembly, a trough and frame assembly, and a mold clamp assembly:

A. said exterior wall assembly comprising a rigid rear wall unit and a rigid front wall unit;

1. said rigid rear wall unit comprising, in operative combinstion, and all firmly joined together as a rigid unit,
   a. a rigid lngitudinally and vertically extending rear vertical interior panel having a smooth interior surface, and an exterior surface and a top edge and, firmly attached thereto,
   b. a plurality of vertically spaced apart longitudinally and horizontally extending rear rigid reinforcement members firmly attached to the exterior surface of said rear vertical interior panel, and firmly attached thereto,
   c. a plurality of longitudinally spaced apart rigid rear vertically extending reinforcement members firmly attached to said horizontally extending rear reinforcement members and extending above the top of said rear vertical interior panel,
   d. a plurality of forwardly extending rigid rear pistons, each firmly attached to each of said rear vertically extending reinforcement members above the top edge of said rear vertical interior panel;
2. said rigid front wall unit comprising, in operative combination, and all firmly joined together as a rigid unit,
   a. a rigid longitudinally and vertically extending front vertical interior panel having a smooth interior surface, and an exterior surface and a top edge, and, firmly attached thereto,
   b. a plurality of front vertically spaced apart longitudinally and horizontally extending rigid reinforcement members firmly attached to said front vertical interior panel at the exterior surface thereof, and, firmly attached thereto,
   c. a plurality of longitudinally spaced apart rigid front vertically extending reinforcement members and said front vertically extending rigid reinforcement members extending vertically above the top of said front vertical interior panel,
   d. a plurality of rearwardly extending rigid front pistons, each firmly attached to one of said front vertically extending rigid reinforcement members above the top edge of said front vertical interior panel;

B. said trough and frame assembly comprising, in operative combination, a longitudinally extending rigid trough mold member and a plurality of horizontally extending rigid sleeves, 1. said longitudinally extending trough mold member having an exterior outline in transverse cross section which outline is downwardly convex and uniform along the entire length of such trough mold member; and said trough mold member having a bottom exterior surface which is smooth and a plurality of longitudinally spaced apart rigid transversely extending members extending across and attached to the transversely spaced apart parts of the interior surface of said trough mold member, an upwardly open chamber in said trough mold member and a weight therein,
2. each of said plurality of horizontally extending hollow rigid sleeves
   a. extending transverse to the length of said trough mold member and each of said horizontally extending hollow rigid sleeves having a cylindrical and sturdy yet resilient sleeve wall, said wall having an interior surface, and a slot at each end thereof extending parallel to the central longitudinal axis of said horizontally extending hollow rigid sleeve, each of said slots at each sleeve end being of equal length and there being a resiliently deformable C-shaped sleeve wall portion adjacent thereto; each of said horizontally extending hollow rigid sleeves being parallel to the other of said plurality of horizontally extending hollow rigid sleeves, and each of said horizontally extending hollow rigid sleeves being
   b. located above the trough mold member and firmly attached thereto;
3. said front and rear rigid wall units extending downward the same distance from said horizontally extending hollow rigid sleeves and said front and rear rigid wall units walls extending further downward from said transversely extending horizontally extending hollow rigid sleeve than the bottom of said trough mold member;

C. said mold clamp assembly comprising 1. a rigid longitudinally extending rod with portions of uniform transverse diameter adjacent each of said horizontally extending hollow rigid sleeves, rod support means supported on said horizontally extending hollow rigid sleeves, said rod rotatably supported on said rod support means; and drive means attached to said rod, 2. releasable locking means attached to said rod, said releasable locking means comprising a sprocket wheel and a pivotal lock arm having a tooth, said tooth operatively engaging said sprocket wheel;

3. a plurality of paris of flexible cables, each having two ends, one end of one of said cables of each pair thereof attached to said rod and another of the ends of each of said cables extending transversely to said rod and attached to a rigid member located above said trough and firmly attached to one of said vertically extending rigid reinforcement members, 4. a pair of rigid pistons slidably located in each of said horizontally extending hollow rigid sleeves; one, inner, end of each of said pistons extending within said cylindrical sleeve wall, and the other, outer, end of each of said pistons extending outwardly of said cylindrical sleeve wall, said front piston extending outwardly of the front end of said horizontally extending hollow rigid sleeves and the said rear piston extending outwardly of the rear end of said horizontally extending hollow rigid sleeve, a portion of the length of each such of said cables being releasably wrapped around said rod, said portion of length of cable being less than the length of said rigid piston in said horizontally extending hollow rigid sleeve; one of said pistons attached to one of the rigid front wall vertically extending reinforcement members and fitting within one, front, end of one of said horizontally extending hollow rigid sleeves, and another like piston attached to one of said rear rigid vertically extending reinforcement members fitting within the other, rear end of said horizontally extending hollow rigid sleeve; one end of said pair of cables attached to said rigid fron vertically extending members and another end of said pair of cables attached to a rigid member attached to one of said rigid rear vertically extending reinforcement members;

5. a vertically extending space between level of the top and the bottom of each of said pair of rigid pistons and the interior surface of said horizontally extending hollow rigid sleeve, and 6. a compressed spring located between the inner ends of said front and rear pistons within each of said horizontally extending hollow rigid of said sleeves.

2. Apparatus as in claim 1 wherein said rearwardly extending front piston on each of said front vertically extending reinforcement members has a front piston central longitudinal axis and the forwardly extending rigid rear piston on each of the rear vertically extending reinforcement members has a rear piston central longitudinal axis and said front portion axis and said rear portion axis are co-axial.

3. Apparatus as in claim 2 wherein:

a. the trough mold member is firmly attached to the sleeves by a plurality of rigid vertical members extending from said trough to said sleeves and other rigid members firmly attached to and extending between said trough and said sleeves at an angle to the vertical;

b. said drive means attached to the rod comprises in operative connection a driven sprocket wheel and a chain, and c. the vertically extending space between the top and bottom of each of said pistons and the interior surface of said sleeve extends for between ½% and 1% of the length of said piston within said sleeve.

* * * * *